US011566536B1

(12) United States Patent
Cox

(10) Patent No.: US 11,566,536 B1
(45) Date of Patent: Jan. 31, 2023

(54) TURBINE HGP COMPONENT WITH STRESS RELIEVING COOLING CIRCUIT

(71) Applicant: General Electric Company, Schenectady, NY (US)

(72) Inventor: Brandon Lee Cox, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/804,350

(22) Filed: May 27, 2022

(51) Int. Cl.
*F01D 25/12* (2006.01)
*F01D 5/18* (2006.01)

(52) U.S. Cl.
CPC ..... *F01D 25/12* (2013.01); *F01D 5/187* (2013.01); *F05D 2220/30* (2013.01); *F05D 2240/81* (2013.01); *F05D 2260/20* (2013.01)

(58) Field of Classification Search
CPC ..... F01D 5/187; F01D 25/12; F05D 2240/81; F05D 2260/20
See application file for complete search history.

(56) References Cited

U.S. PATENT DOCUMENTS 5,383,766 A * 1/1995 Przirembel ..... F01D 5/186 416/97 A
5,813,836 A 9/1998 Starkweather
6,206,638 B1 3/2001 Glynn et al.
7,568,887 B1 * 8/2009 Liang ..... F01D 5/187 416/97 R
7,854,591 B2 * 12/2010 Liang ..... F01D 5/187 415/115
8,167,559 B2 * 5/2012 Liang ..... F01D 25/12 415/115
10,100,646 B2 * 10/2018 Propheter-Hinckley ..... B22C 9/10
10,364,681 B2 7/2019 Krumanaker et al.
11,021,969 B2 6/2021 Krumanaker et al.
2019/0120064 A1 * 4/2019 Jennings ..... F01D 5/186

FOREIGN PATENT DOCUMENTS

EP 3232002 A1 10/2017

* cited by examiner

*Primary Examiner* — Michael Lebentritt
*Assistant Examiner* — Danielle M. Christensen
(74) *Attorney, Agent, or Firm* — James Pemrick; Charlotte Wilson; Hoffman Warnick LLC

(57) ABSTRACT

A turbine hot gas path (HGP) component includes a body having an exterior surface exposed to a hot gas path, and a cooling circuit defined along an interior surface of the body and fluidly coupled to a coolant source. The cooling circuit includes a plurality of sections spaced from one another but fluidly connected. Each section includes a wall defining at least one cooling passage, and a connector wall coupling between the wall of a first section of the plurality of sections and the wall of an adjacent, second section of the plurality of sections. The wall of the first section and the wall of the adjacent, second section are spaced apart, segregating stress between the sections. The connector wall is more flexible than: the wall of the first section, the wall of the adjacent, second section, and the body, allowing stress relief between the sections.

20 Claims, 11 Drawing Sheets

HGP

TURBINE HGP COMPONENT WITH STRESS RELIEVING COOLING CIRCUIT

TECHNICAL FIELD

The disclosure relates generally to turbines and, more particularly, to a turbine hot gas path (HGP) component including a cooling circuit including spaced sections that relieve stress.

BACKGROUND

Turbines include components exposed to a hot gas of the turbine such as a steam or combustion gas flow. Hot gas path (HGP) components can take a variety of forms including, for example, airfoils of nozzles, airfoils of turbine blades, and shrouds between nozzle and blade stages. HGP components typically include various cooling circuits that deliver coolant to reduce the temperature of the components. HGP components experience high stresses due to the dynamics and the temperature differentials to which they are exposed. The presence of cooling circuits in the HGP components limits the ability to provide stress relief.

BRIEF DESCRIPTION

All aspects, examples and features mentioned below can be combined in any technically possible way.

An aspect of the disclosure provides a turbine hot gas path (HGP) component, comprising: a body having an exterior surface for exposing to a hot gas path; and a cooling circuit defined along an interior surface of the body and fluidly coupled to a coolant source, the cooling circuit including a plurality of sections spaced from one another but fluidly connected, each section including: a first wall including a first sidewall and a second sidewall coupled by a first turn portion to define a first cooling passage between the first sidewall and the second sidewall, the first turn portion coupling to a first end of each of the first and second sidewalls, a second end of the first sidewall of the first wall coupled to the interior surface of the body to define a second cooling passage between the first sidewall and the interior surface of the body; a first connector wall coupling a second end of the second sidewall of the first wall of a first section of the plurality of sections to the first wall of an adjacent, second section of the plurality of sections in a spaced manner; and at least one opening defined in the first sidewall and fluidly coupling the first cooling passage to the second cooling passage.

Another aspect of the disclosure includes any of the preceding aspects, and the first connector wall is more flexible than the first wall and the body.

Another aspect of the disclosure includes any of the preceding aspects, and further comprising a plurality of tubes extending through the second sidewall and the first sidewall and terminating at the interior surface of the body.

Another aspect of the disclosure includes any of the preceding aspects, and further comprising a first plurality of pillars spacing the first sidewall from the second sidewall, and a second plurality of pillars spacing the first sidewall from the interior surface of the body.

Another aspect of the disclosure includes any of the preceding aspects, and the first connector wall partially defines a third cooling passage fluidly coupling the first cooling passage of the first section of the plurality of sections to the second cooling passage of the second, adjacent section of the plurality of sections.

Another aspect of the disclosure includes any of the preceding aspects, and the third cooling passage isolates stress between the first section and the adjacent, second section of the plurality of sections.

Another aspect of the disclosure includes any of the preceding aspects, and the first connector wall is curved away from the interior surface of the body.

Another aspect of the disclosure includes any of the preceding aspects, and the body is an airfoil of one of a turbine blade and a turbine nozzle.

Another aspect of the disclosure includes any of the preceding aspects, and the body is a shroud between a turbine blade stage and a turbine nozzle stage.

Another aspect of the disclosure includes any of the preceding aspects, and further comprising a first endmost section of the plurality of sections, the first endmost section including: a second wall including a third sidewall and a fourth sidewall coupled by a second turn portion to define a third cooling passage between the third sidewall and the fourth sidewall, the second turn portion coupling to a first end of each of the third and fourth sidewalls, a second end of the third sidewall of the second wall coupled to the interior surface of the body to define a fourth cooling passage between the third sidewall and the interior surface of the body; and a second connector wall coupling a second end of the fourth sidewall of the second wall of the plurality of sections to the coolant source.

Another aspect of the disclosure includes any of the preceding aspects, and further comprising a second endmost section of the plurality of sections opposite the first endmost section of the plurality of sections, the second endmost section including: a third wall including a fifth sidewall and a sixth sidewall coupled by a third turn portion to define a fifth cooling passage between the fifth sidewall and the sixth sidewall, the third turn portion coupling to a first end of each of the fifth and sixth sidewalls, a second end of the fifth sidewall of the third wall coupled to the interior surface of the body to define a sixth cooling passage between the fifth sidewall and the interior surface of the body; a third connector wall coupling a second end of the sixth sidewall of the third wall to a penultimate section of the plurality of sections adjacent the second endmost section of the plurality of sections; and a terminating wall coupling the third turn portion to the interior surface of the body.

Another aspect of the disclosure includes a turbine hot gas path (HGP) component, comprising: a body having an exterior surface exposed to a hot gas path; a cooling circuit defined along an interior surface of the body and fluidly coupled to a coolant source, the cooling circuit including a plurality of sections spaced from one another but fluidly connected, each section including: a wall defining at least one cooling passage; and a first connector wall coupling between the wall of a first section of the plurality of sections and the wall of an adjacent, second section of the plurality of sections, wherein the wall of the first section and the wall of the adjacent, second section are spaced apart, and wherein the first connector wall is more flexible than: the wall of the first section, the wall of the adjacent, second section, and the body.

Another aspect of the disclosure includes any of the preceding aspects, and the wall includes a first wall including a first sidewall and a second sidewall coupled by a first turn portion to define a first cooling passage between the first sidewall and the second sidewall, the first turn portion coupling to a first end of each of the first and second sidewalls, a second end of the first sidewall of the first wall coupled to the interior surface of the body to define a second cooling passage between the first sidewall and the interior surface of the body, and wherein the first connector wall couples a second end of the second sidewall of the first wall of a first section of the plurality of sections to the first wall of an adjacent, second section of the plurality of sections.

Another aspect of the disclosure includes any of the preceding aspects, and further comprising at least one opening defined in the first sidewall and fluidly coupling the first cooling passage to the second cooling passage.

Another aspect of the disclosure includes any of the preceding aspects, and further comprising a plurality of tubes extending through the second sidewall and the first sidewall and terminating at the interior surface of the body.

Another aspect of the disclosure includes any of the preceding aspects, and further comprising a first plurality of pillars spacing the first sidewall from the second sidewall, and a second plurality of pillars spacing the first sidewall from the interior surface of the body.

Another aspect of the disclosure includes any of the preceding aspects, and the first connector wall partially defines a third cooling passage spacing the first section of the plurality of sections from the adjacent, second section of the plurality of sections, and fluidly coupling the first cooling passage of the first section of the plurality of sections to the second cooling passage of the second, adjacent section of the plurality of sections.

Another aspect of the disclosure includes any of the preceding aspects, and the third cooling passage isolates stress between the first section and the adjacent, second section of the plurality of sections.

Another aspect of the disclosure includes any of the preceding aspects, and the first connector wall is curved away from the interior surface of the body.

Another aspect of the disclosure includes any of the preceding aspects, and the body is one of: an airfoil of a turbine blade, an airfoil of a turbine nozzle, and a shroud between a turbine blade stage and a turbine nozzle stage.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
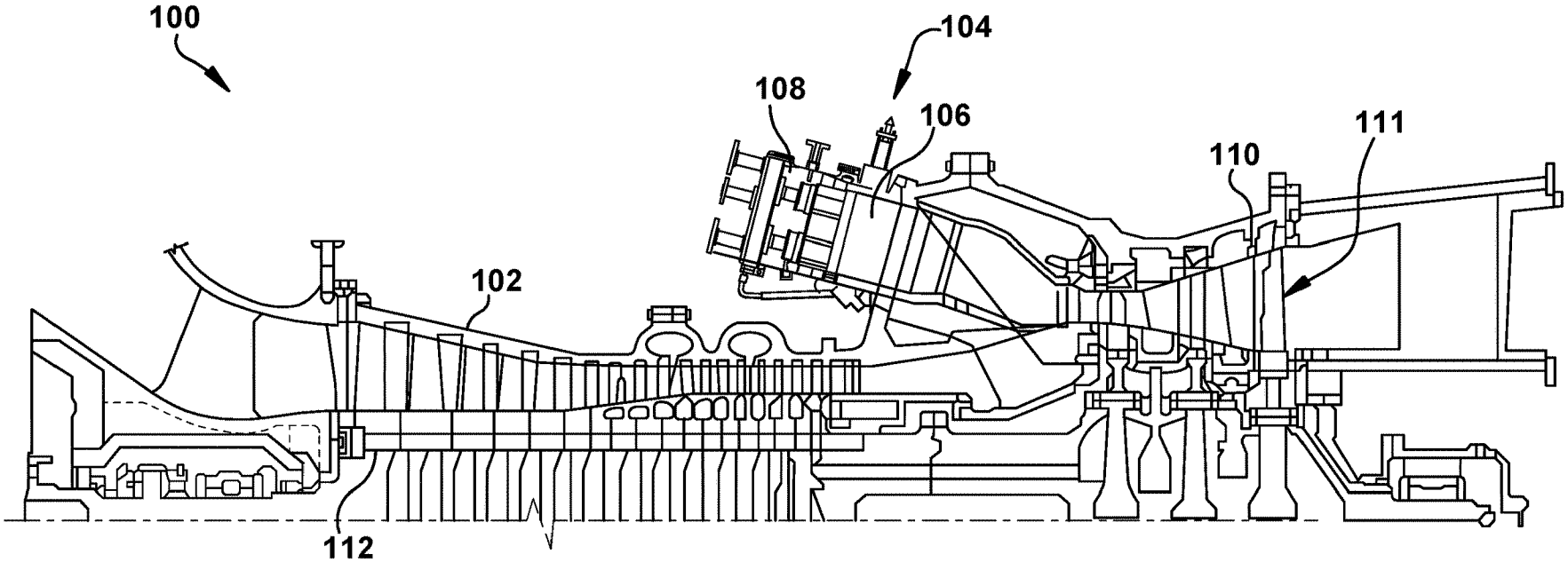
Fig. 1 (Prior Art)
FIG. 1 shows a schematic view of an illustrative turbomachine in the form of a gas turbine system.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within a turbomachine. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow (i.e., the direction from which the flow originates). The terms "forward" and "aft," without any further specificity, refer to directions, with "forward" referring to the front or compressor end of the engine, and "aft" referring to the rearward section of the engine.

It is often required to describe parts that are disposed at different radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently described component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, no intervening elements or layers are present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides a turbine hot gas path (HGP) component. The HGP component includes a body having an exterior surface exposed to a hot gas path, and a cooling circuit defined along an interior surface of the body and fluidly coupled to a coolant source. The cooling circuit includes a plurality of sections spaced from one another but fluidly connected. Each section includes a wall defining at least one cooling passage, and a connector wall coupling between the wall of a first section of the plurality of sections and the wall of an adjacent, second section of the plurality of sections. The wall of the first section and the wall of the adjacent, second section are spaced apart, preventing stress transmission between the sections. The connector wall is more flexible than the wall of the first and second sections and the body, allowing stress relief between the sections.

FIG. 1 shows a schematic illustration of an illustrative industrial machine, HGP components of which may include a cooling circuit according to teachings of the disclosure. In the example, the machine includes a turbomachine 100 in the form of a combustion or gas turbine system. Turbomachine 100 includes a compressor 102 and a combustor 104. Combustor 104 includes a combustion region 106 and a fuel nozzle assembly 108. Turbomachine 100 also includes a turbine 110 and a common compressor/turbine shaft 112 (sometimes referred to as a rotor 112).

In one embodiment, GT system 100 is a 7HA.03 engine, commercially available from General Electric Company, Greenville, S.C. The present disclosure is not limited to any one particular GT system and may be implemented in connection with other engines including, for example, the other HA, F, B, LM, GT, TM and E-class engine models of General Electric Company, and engine models of other companies. The present disclosure is not limited to any particular turbine or turbomachine and may be applicable to, for example, steam turbines, jet engines, compressors, turbofans, etc. Furthermore, the present disclosure is not limited to any particular turbomachine and may be applied to any form of component exposed to a hot gas path and requiring cooling and stress relief.

In operation, air flows through compressor 102, and compressed air is supplied to combustor 104. Specifically, the compressed air is supplied to fuel nozzle assembly 108 that is integral to combustor 104. Assembly 108 is in flow communication with combustion region 106. Fuel nozzle assembly 108 is also in flow communication with a fuel source (not shown) and channels fuel and air to combustion region 106. Combustor 104 ignites and combusts fuel. Combustor 104 is in flow communication with turbine assembly 110 within which gas stream thermal energy is converted to mechanical rotational energy. Turbine assembly 110 includes a turbine 111 that rotatably couples to and drives rotor 112. Compressor 102 also is rotatably coupled to rotor 112. In the illustrative embodiment, there is a plurality of combustors 106 and fuel nozzle assemblies 108.

Figure 2:
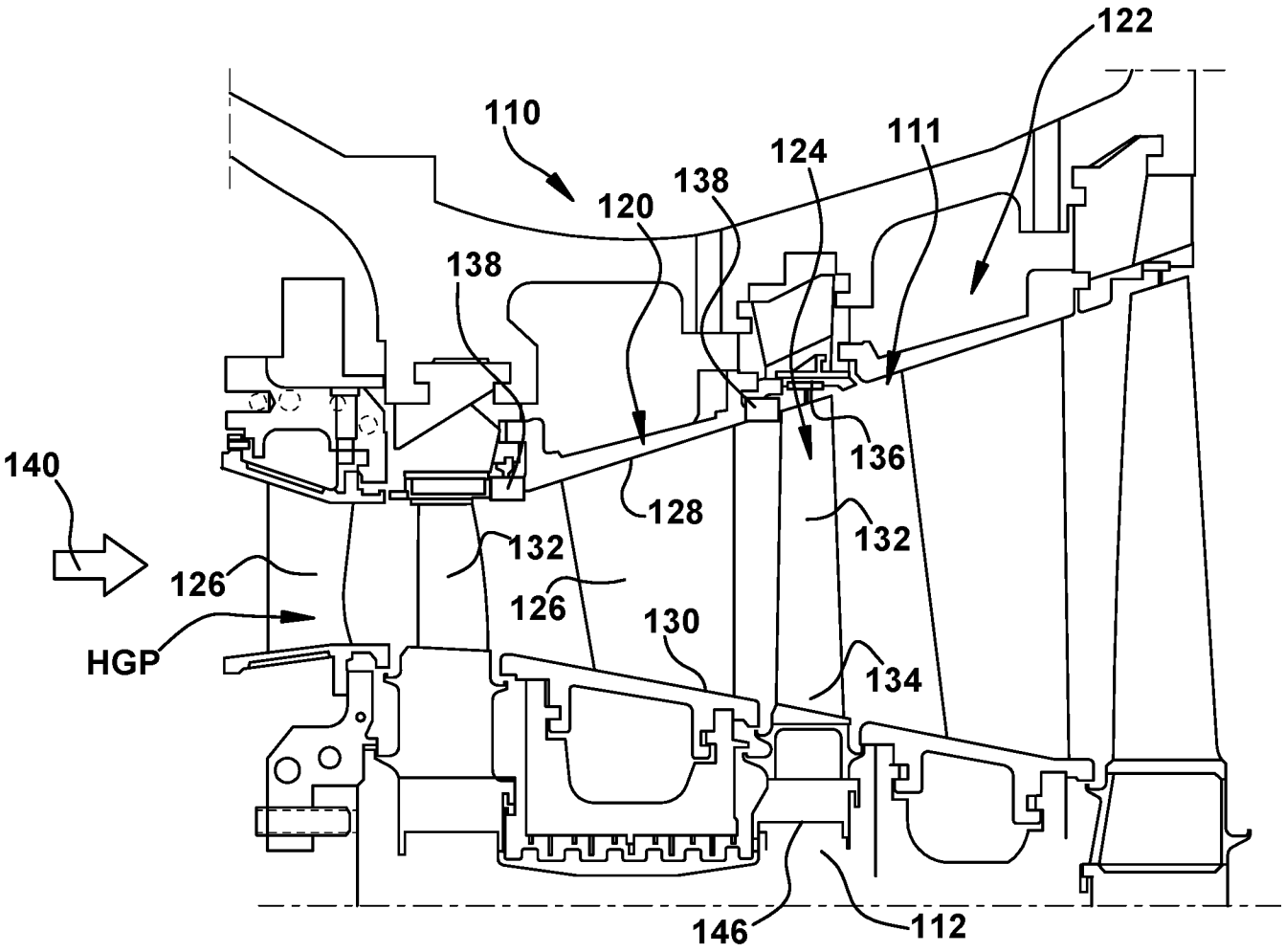
Fig. 2 (Prior Art)
FIG. 2 shows a cross-sectional view of an illustrative gas turbine assembly that may be used with the gas turbine system in FIG. 1.

FIG. 2 shows a cross-sectional view of an illustrative turbine assembly 110 of turbomachine 100 (FIG. 1) that may be used with the gas turbine system in FIG. 1. Turbine 111 of turbine assembly 110 includes a row or stage of nozzles 120 coupled to a stationary casing 122 of turbomachine 100 and axially adjacent a row or stage of rotating blades 124. A nozzle 126 (also known as a vane) may be held in turbine assembly 110 by a radially outer platform 128 and a radially inner platform 130. Each stage of blades 124 in turbine assembly 110 includes rotating blades 132 coupled to rotor 112 and rotating with the rotor. Rotating blades 132 may include a radially inner platform 134 (at a root of the blade) coupled to rotor 112 and a radially outer tip 136 (at a tip of the blade). Shrouds 138 may separate adjacent stages of nozzles 126 and rotating blades 132.

A working fluid 140, including for example combustion gases in the example gas turbine, passes through turbine 111 along what is referred to as a hot gas path (hereafter simply "HGP"). The HGP can be any area of turbine 111 exposed to hot temperatures. Parts of turbine 111 or other machine exposed to the HGP are referred to as "HGP components." In the example turbine 111, nozzles 126, blades 132 and shrouds 138 are all examples of HGP components that may benefit from the teachings of the disclosure. It will be recognized that other parts of turbine 111 exposed to the HGP may also be considered HGP components.

Figure 3:
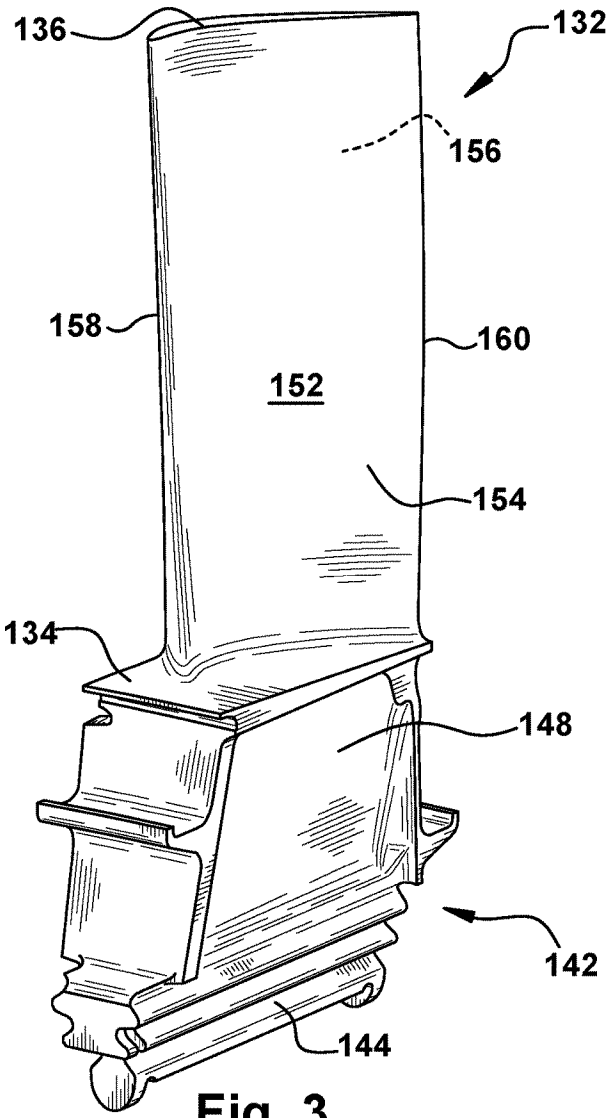
Fig. 3 (Prior Art)
FIG. 3 shows a perspective view of a turbine rotating blade of the type in which embodiments of the disclosure may be employed.
Figure 4:
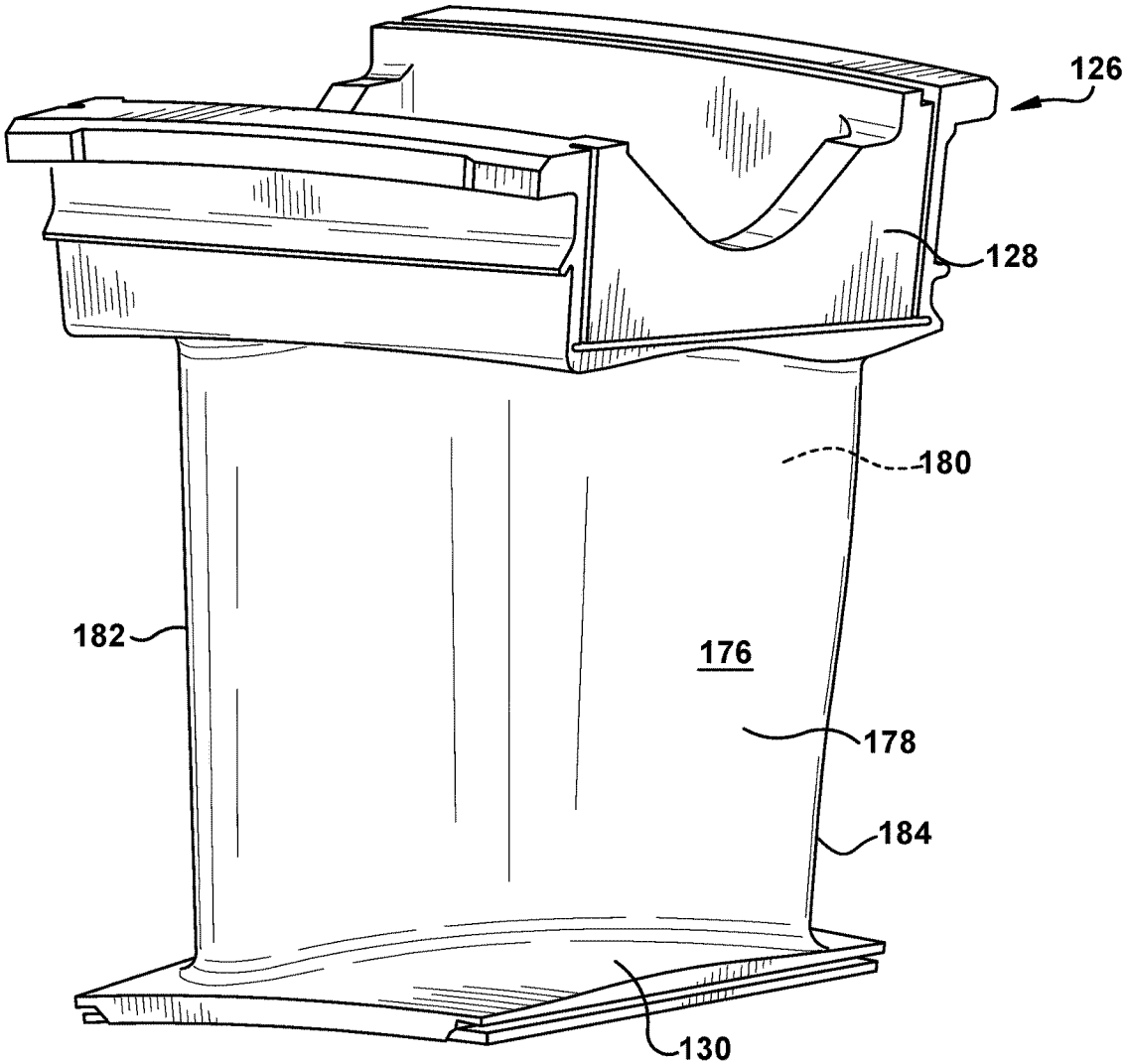
Fig. 4 (Prior Art)
FIG. 4 shows a perspective view of a turbine nozzle of the type in which embodiments of the disclosure may be employed.
Figure 5:
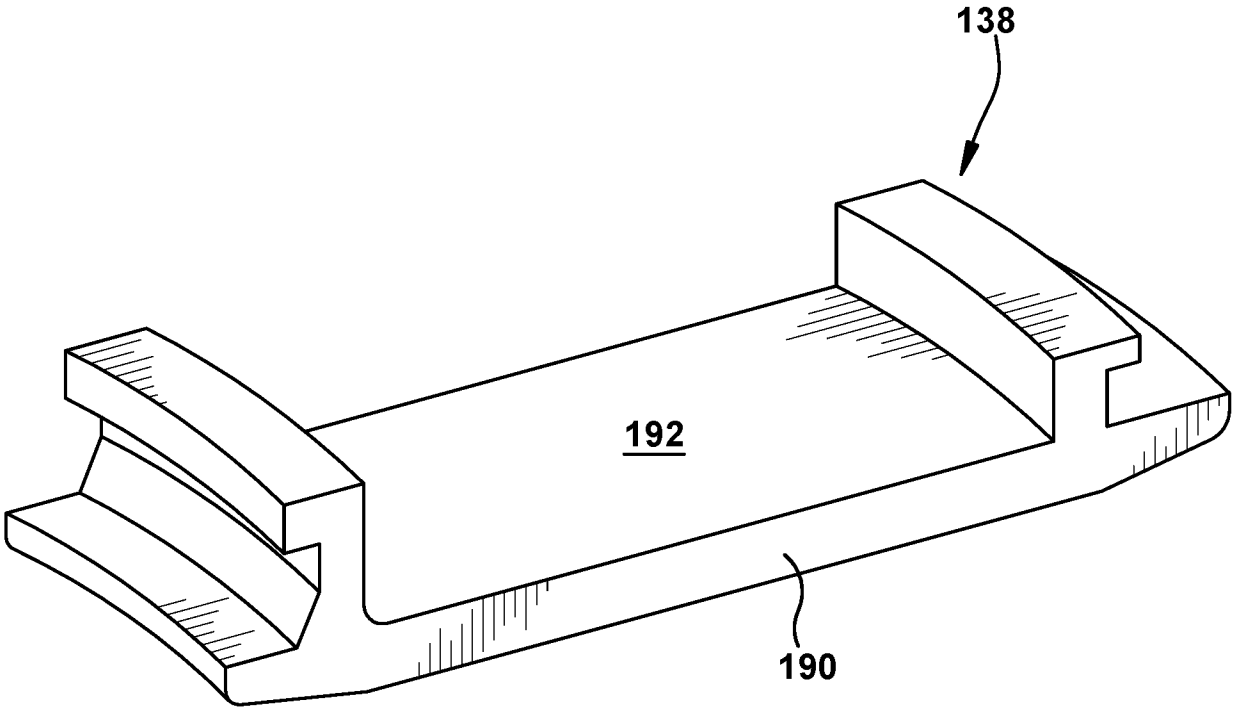
Fig. 5 (Prior Art)
FIG. 5 shows a perspective view of a turbine shroud of the type in which embodiments of the disclosure may be employed.

FIGS. 3-5 show perspective views of example HGP components of turbine 111 in which teachings of the disclosure may be employed. FIG. 3 shows a perspective view of a turbine rotating blade 132 of the type in which embodiments of the disclosure may be employed. Turbine rotating blade 132 includes a root 142 by which rotating blade 132 attaches to rotor 112 (FIG. 2). Root 142 may include a dovetail 144 configured for mounting in a corresponding dovetail slot in the perimeter of a rotor wheel 146 (FIG. 2)

of rotor 112 (FIG. 2). Root 142 may further include a shank 148 that extends between dovetail 142 and platform 134, which is disposed at the junction of airfoil 152 and root 142 and defines a portion of the inboard boundary of the HGP through turbine assembly 110. It will be appreciated that airfoil 152 is the active component of rotating blade 132 that intercepts the flow of working fluid 140 (FIG. 2) and induces the rotor wheel 146 to rotate. It will be seen that airfoil 152 of rotating blade 132 includes a concave pressure side (PS) outer wall 154 and a circumferentially or laterally opposite convex suction side (SS) outer wall 156 extending axially between opposite leading and trailing edges 158, 160, respectively. Sidewalls 154 and 156 also extend in the radial direction from platform 134 to radial outer tip 136. Tip 136 may include any now known or later developed tip shroud (not shown). A cooling circuit 200 (FIGS. 6-11) according to embodiments of the disclosure can be used, for example, within airfoil 152, platform 134, or other parts of rotating blade 132.

FIG. 4 shows a perspective view of a stationary nozzle 126 of the type in which embodiments of the disclosure may be employed. Stationary nozzle 126 includes radial outer platform 128 by which stationary nozzle 126 attaches to stationary casing 122 (FIG. 2) of the turbomachine. Outer platform 128 may include any now known or later developed mounting configuration for mounting in a corresponding mount in the casing. Stationary nozzle 126 may further include radially inner platform 130 for positioning between platforms 134 of adjacent turbine rotating blades 132 (FIG. 3). Outer and inner nozzle platforms 128, 130 define respective portions of the outboard and inboard boundary of the HGP through turbine assembly 110.

It will be appreciated that an airfoil 176 is the active component of stationary nozzle 126 that intercepts the flow of working fluid 140 (FIG. 2) and directs it towards turbine rotating blades 132 (FIG. 3). It will be seen that airfoil 176 of stationary nozzle 126 includes a concave pressure side (PS) outer wall 178 and a circumferentially or laterally opposite convex suction side (SS) outer wall 180 extending axially between opposite leading and trailing edges 182, 184 respectively. Sidewalls 178 and 180 also extend in the radial direction from platform 128 to platform 130. A cooling circuit 200 (FIGS. 6-11) according to embodiments of the disclosure can be used, for example, within airfoil 176, platforms 128, 130, or other parts of stationary nozzle 126.

FIG. 5 shows a perspective view of a shroud 138 of the type in which embodiments of the disclosure may be employed. Shroud 138 may include a platform 190 for positioning between tips 136 (FIGS. 2-3) of turbine rotating blades 132 (FIGS. 2-3) and radially outer platforms 128 (FIGS. 2 and 4) of nozzles 126 (FIGS. 2 and 4). Shroud 138 may fasten to casing 122 (FIG. 2) in any fashion. A cooling circuit 200 (FIGS. 6-11) according to embodiments of the disclosure can be used, for example, within an inner surface 192 or other parts of shroud 138.

Referring to FIGS. 3-5, as noted, embodiments of the disclosure described herein may be applied to any HGP component of turbine 111 (FIG. 2), such as but not limited to turbine rotating blades 132 (FIG. 3), stationary nozzles 126 (FIG. 4) and/or shrouds 138 (FIG. 5). It will be recognized that HGP components oftentimes include cooling circuits (not shown in FIGS. 3-5) to deliver a coolant to parts thereof exposed to the HGP of turbine 111 to cool those parts. Referring to FIGS. 6-11, for purposes of description, a cooling circuit 200 according to embodiments of the disclosure will be illustrated and described relative to an airfoil 152, 176 for rotating blade 132 or nozzle 126. It is emphasized that the teachings of the disclosure may be applied to any HGP component.

Figure 6:
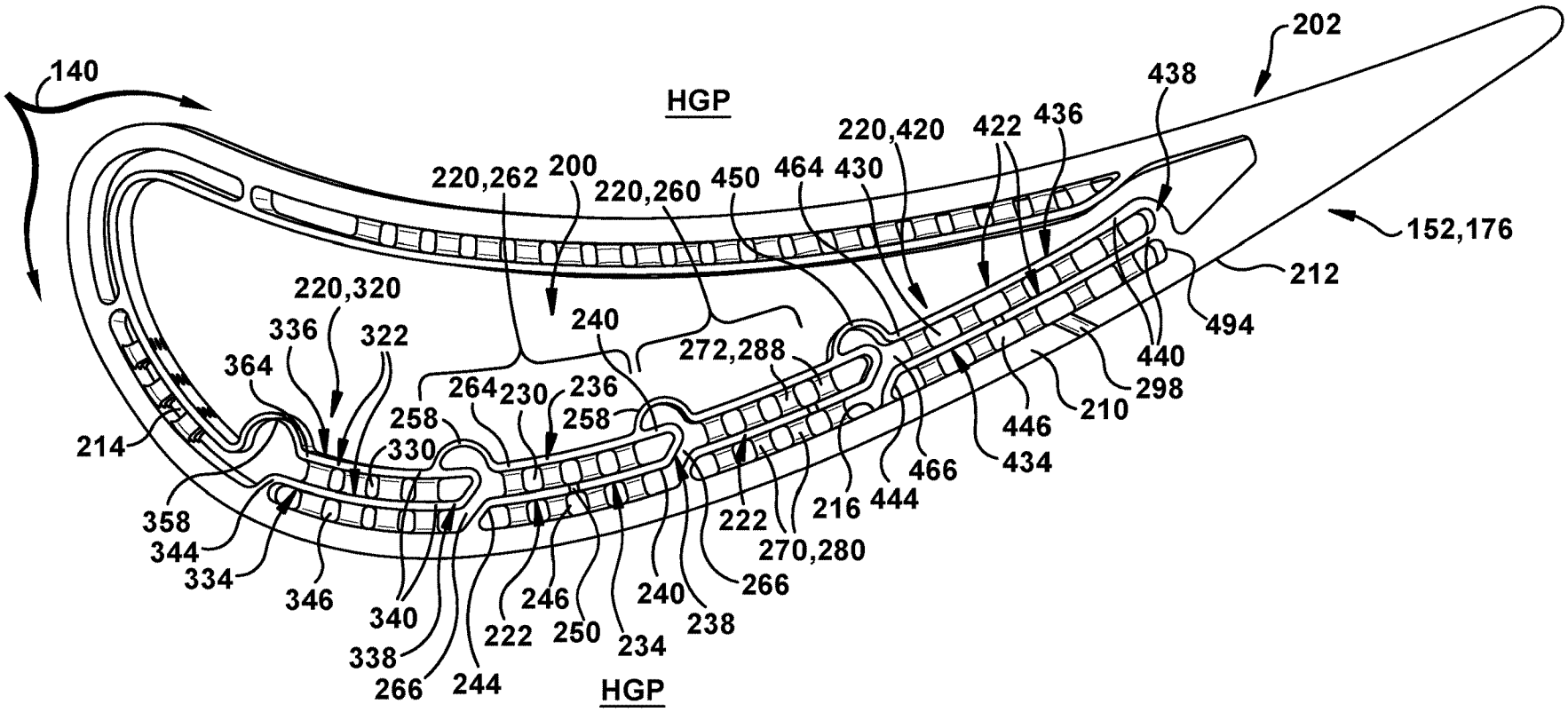
FIG. 6 shows a cross-sectional view of an illustrative HGP component including a cooling circuit including a plurality of sections, according to embodiments of the disclosure.

FIG. 6 shows a cross-sectional view of an illustrative turbine HGP component 202 according to embodiments of the disclosure. As shown in FIG. 6, HGP component 202 may include a body 210 having an exterior surface 212 for exposing to the HGP. Body 210 can take any form depending on the type of HGP component. In terms of an airfoil 152, 176, body 210 has an airfoil cross-section. In the example shown, body 210 includes one or more coolant sources 214 therein. Coolant source(s) 214 may be a dedicated passage through body 210 for cooling circuit 200 or may be any other cooling circuit upstream of cooling circuit 200 according to embodiments of the disclosure. Any number of coolant sources 214 may be used.

Cooling circuit 200 is defined along an interior surface 216 of body 210 and is fluidly coupled to coolant source(s) 214. Interior surface 216 of body 210 may be, for example, any surface not directly exposed to the HGP. Cooling circuit 200 includes a plurality of sections 220 spaced from one another but fluidly connected. Any number of sections 220 can be used. For purposes of description, sections 220 may include 'regular sections' referenced with just label '220', and 'endmost sections' 320, 420 that are similar to regular sections 220 but include some different structure to allow coupling of cooling circuit 200 to other parts of HGP component 202. In FIG. 6, four sections 220 are used, but as will be described, more than two 'regular' sections 220 are also possible.

Figure 7:
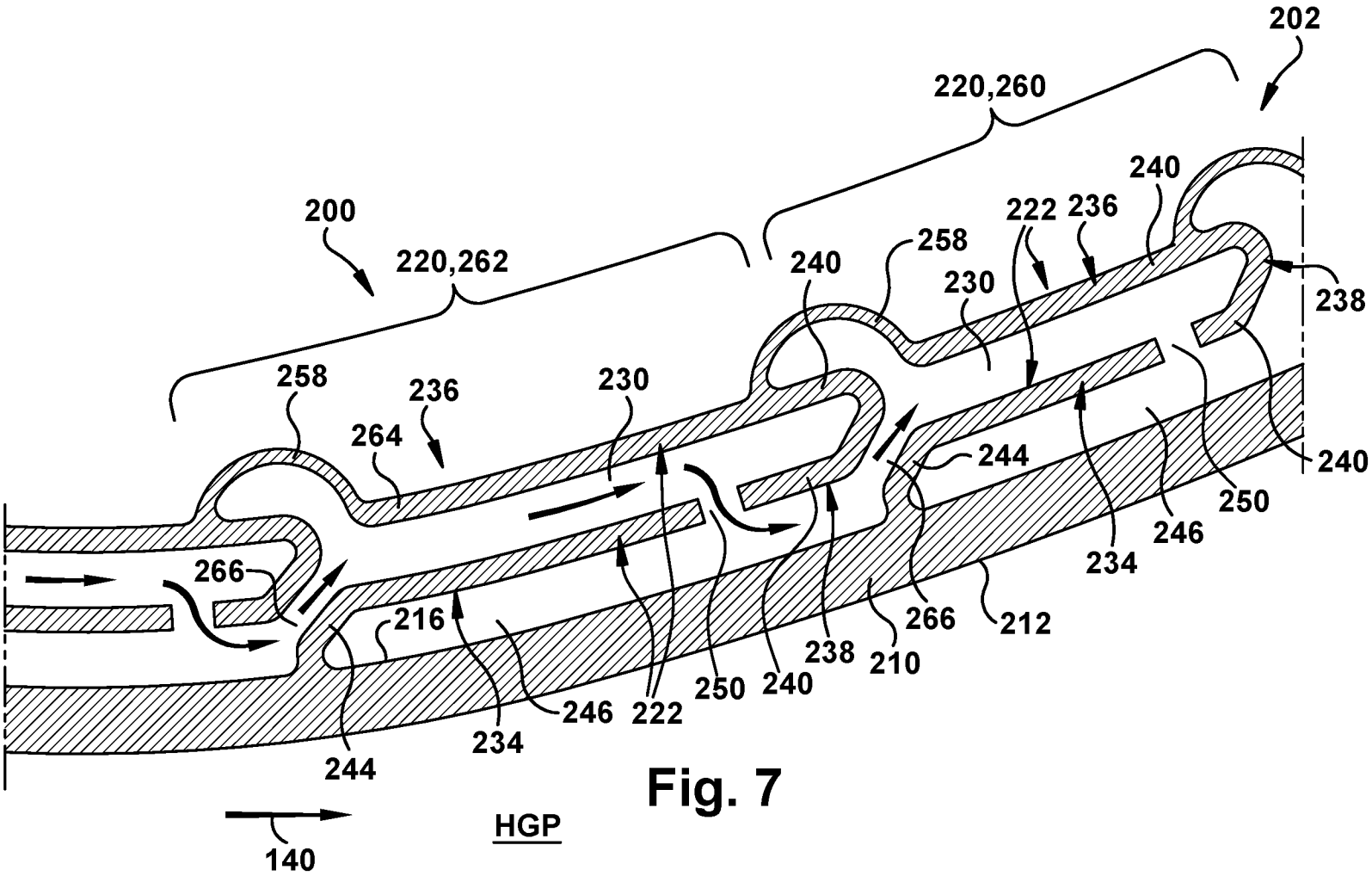
FIG. 7 shows an enlarged cross-sectional view of an example section of the cooling circuit, according to embodiments of the disclosure.

FIG. 7 shows an enlarged cross-sectional view of two sections 220 according to embodiments of the disclosure. Referring to FIGS. 6 and 7, each section 220 may include a wall 222 defining at least one cooling passage. Wall 222 can take a variety of forms. In one example, wall 222 may be generally U-shaped (shown laying on its side). In this example, wall 222 defines a first cooling passage 230 within a first sidewall 234 and a second sidewall 236 that are coupled by a turn portion 238. Turn portion 238 couples to a first end 240 of each of first and second sidewalls 234, 236. While shown as generally planar and parallel, sidewalls 234, 236 can be non-planar and can be non-parallel. Sidewall(s) 234, 236 may optionally include any structure necessary to create the desired flow in terms of, for example, flow direction, flow volume, flow rate, or back pressure. A second end 244 of first sidewall 234 of wall 222 is coupled to interior surface 216 of body 210 to define a second cooling passage 246 between first sidewall 234 and interior surface 216 of body 210. Second cooling passage 246 contacts interior surface 216 and is therefore closer to the HGP. First cooling passage 230 is relatively more inward in body 210 compared to second cooling passage 246. In this example, at least one opening 250 is defined in first sidewall 234 for fluidly coupling first (inner) cooling passage 230 to second (outer) cooling passage 246. In this manner, coolant flowing in one of cooling passages 230, 246 can pass to the other cooling passage. While one opening 250 is shown in FIGS. 6 and 7, any number of openings 250 can be used, e.g., into or out of the plane of the page of the two figures. See also FIGS. 8-9, in which a plurality of openings 250 are employed along a length of first sidewall 234.

As shown in FIGS. 6-7, each wall 222 of each section 220 is spaced from wall 222 of an adjacent section 220. The spacing prevents stress transmission between sections 220 and along cooling circuit 200 and along body 210.

Sections 220 of cooling circuit 200 also include a connector wall 258 coupling between wall 222 of a downstream (first) section 260 of plurality of sections 220 and wall 222 of an adjacent, upstream (second) section 262 of plurality of sections 220. In the example shown, connector wall 258 couples a second end 264 of second sidewall 236 of wall 222 of downstream section 260 of plurality of sections 220 to wall 222 of adjacent upstream section 262 of plurality of sections 220 in a spaced manner. As illustrated, wall 222 of downstream section 260 and wall 222 of adjacent, upstream section 262 remain spaced apart. That is, the U-shaped wall 222 (including first sidewall 234 with its second end 244 that connects to interior surface 216 of the HGP component 202, turn portion 238, and second sidewall 236) of downstream section 260 do not contact the respective structures of the U-shaped wall 222 of upstream section 262.

More specifically, a third cooling passage 266 is defined between second end 244 of first sidewall 234 of one wall 222 and turn portion 238 of another wall 222 upstream of and adjacent to the one wall 222. Third cooling passage 266 is defined radially between connector wall 258 and second end 244 of first sidewall 234. In such configuration, third cooling passage 266 fluidly couples second (outer) cooling passage 246 of upstream section 262 of plurality of sections 220 to first (inner) cooling passage 230 of downstream section 260 of plurality of sections 220. Coolant in second outer cooling passage 246 of upstream section 262 can thus flow to first inner cooling passage 230 of downstream section 260. Third cooling passage 266 isolates stress between downstream section 260 and adjacent, upstream section 262 of plurality of sections 220. The arrangement can be repeated for as many sections 220 and length of cooling circuit 200, as desired.

Connector wall 258 may have the same flexibility as other walls in sections 220. In this case, the spacing provided by third cooling passage 266 prevents stress transmission between sections 220 (e.g., adjacent sections 260, 262) and along body 210 of HGP component 202. In other embodiments, connector wall 258 is more flexible than other structures in cooling circuit 200 to allow for additional stress relief in HGP component 202. For example, connector wall 258 may be more flexible than wall(s) 222 of adjacent sections 260, 262, and more flexible than body 210. That is, connector wall 258 may be more flexible than wall 222 of downstream section 260, wall 222 of adjacent, upstream section 262, and body 210. The flexibility of connector wall 258 may be provided in any number of ways such as, but not limited to: voids in the wall 258, making the wall 258 thinner than other walls, and/or providing structures that allow it to flex, such as a curvature or arcuate portion.

In the example shown, connector wall 258 is curved away from interior surface 216 of body 210. In the airfoil example shown, the curvature would be inwardly towards a center of the airfoil. The flexibility of connector wall 258 may further isolate stress to prevent stress transmission. Connector wall 258 can also have other shapes than a simple curve.

Figure 8:
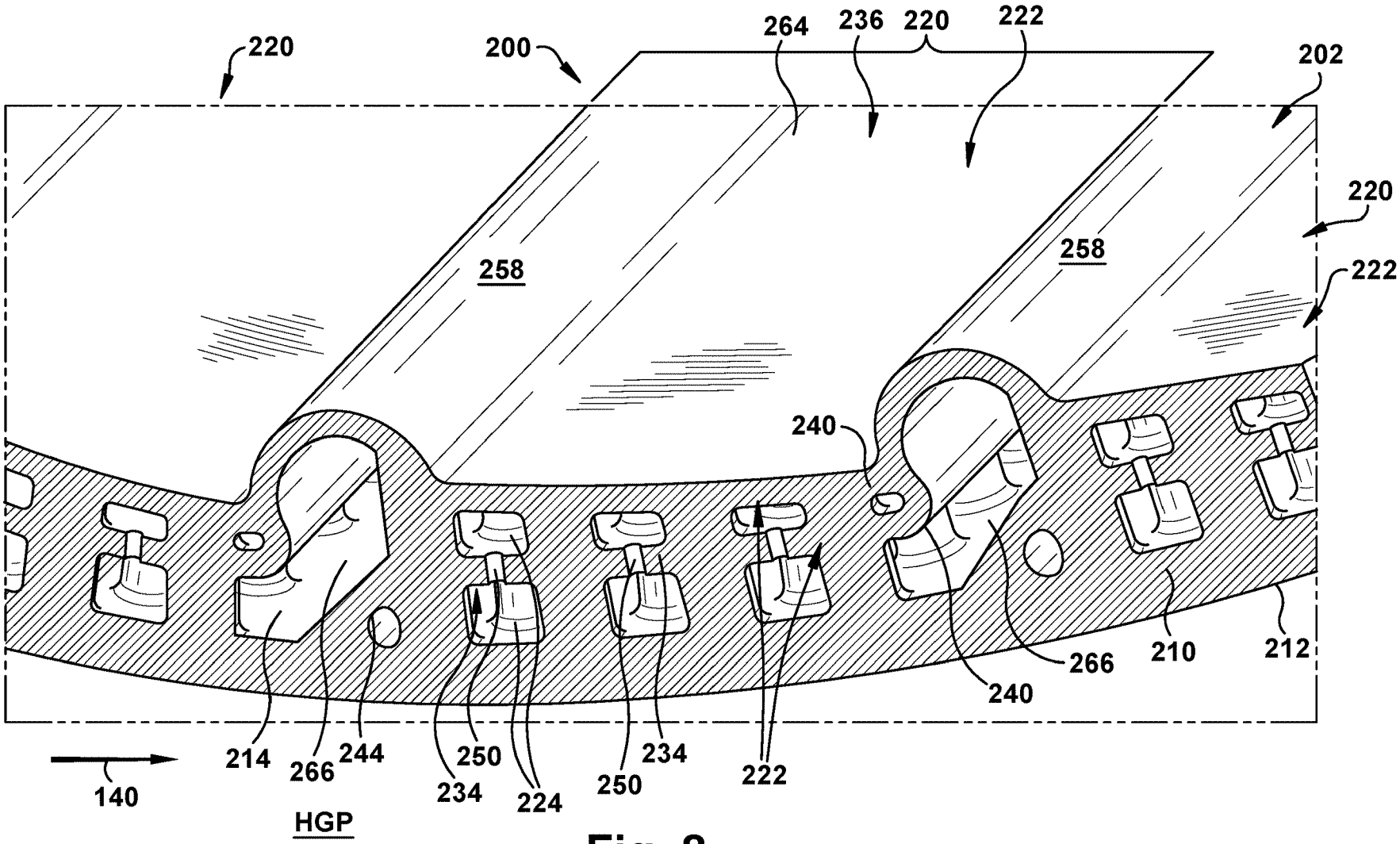
FIG. 8 shows a perspective view of a section of the cooling circuit, according to other embodiments of the disclosure.
Figure 9:
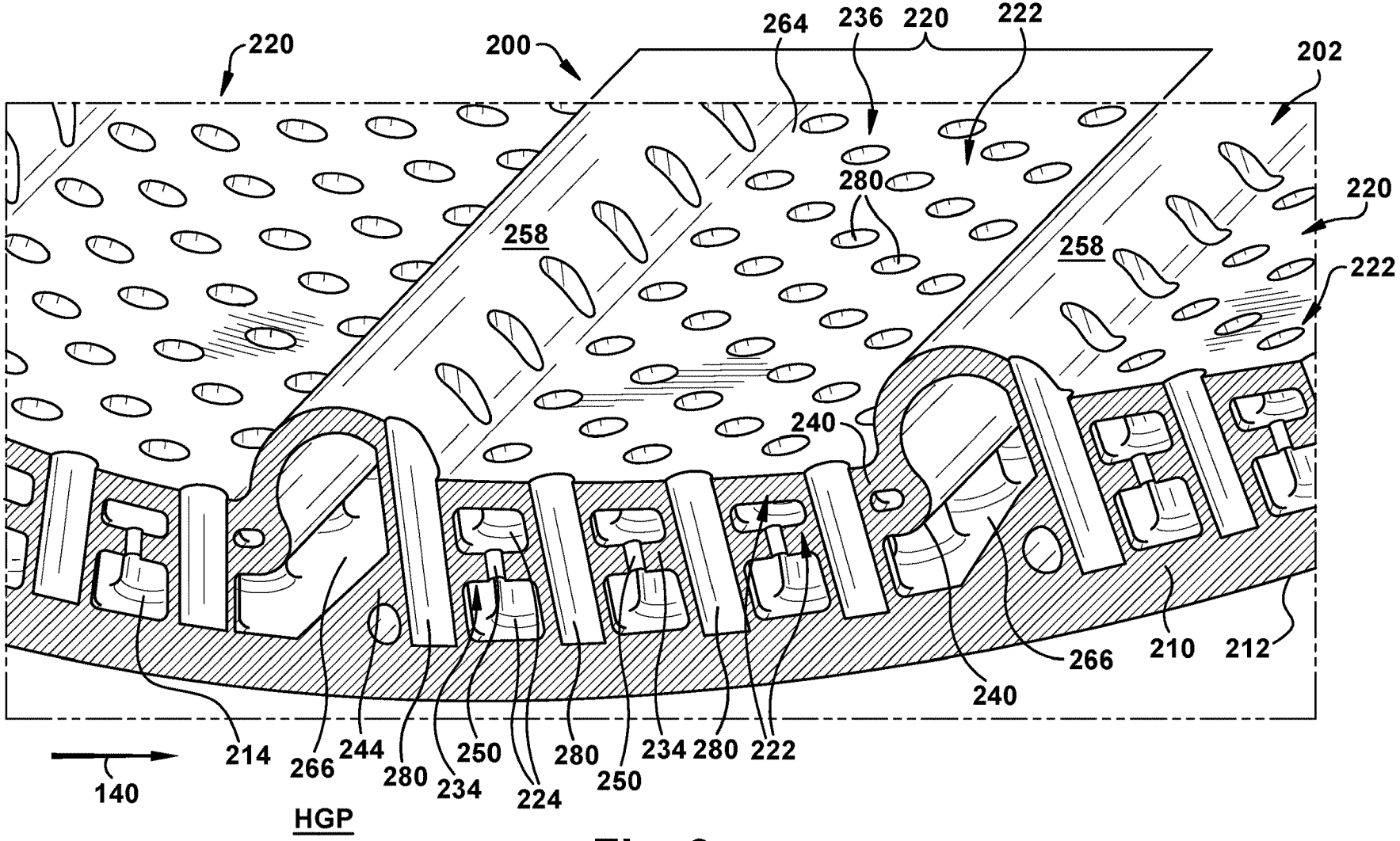
FIG. 9 shows a perspective view of a section of the cooling circuit, according to yet other embodiments of the disclosure.

Walls 222 of sections 220 may be self-supporting, as shown in FIG. 7. FIGS. 8 and 9 show perspective views of sections 220 of cooling circuit 200 according to other embodiments. As shown in FIGS. 6 and 8, a first plurality of pillars 272 may space first sidewall 234 from second sidewall 236, and a second plurality of pillars 270 may space first sidewall 234 from interior surface 216 of body 210. Pillars 270, 272 may be solid material. Although shown in an aligned and one-for-one arrangement, pillars 270, 272 can be numbered, arranged, and spaced in any fashion. Pillars 270, 272 can position wall 222, e.g., first and second sidewalls 234, 236, in any fashion and with any desired rigidity/flexibility.

FIG. 9 shows a perspective view of a section 220 according to other embodiments in which, rather than pillars 270, 272 being used, a plurality of tubes 280 extend through first and second sidewalls 234, 236, terminating at interior surface 216 of body 210. Tubes 280 can support and/or arrange first and second sidewalls 234, 236 (and connector wall 258) in the same fashion as pillars 270, 272. However, tubes 280 may also allow coolant from a center of HGP component 202 or other location to reach interior surface 216 of body 210 to provide additional cooling. Pillars 270, 272 and tubes 280 can have any outer cross-section, and tubes 280 can have any internal cross-section. In other embodiments, pillars and tubes can be intermixed. Pillars 270, 272 and/or tubes 280 are also shown in FIG. 6.

Returning to FIG. 6, cooling circuit 200 can include endmost sections 320, 420 that couple sections 220 of cooling circuit 200 to other cooling structures. Cooling circuit 200 can include a first endmost section 320 as part of plurality of sections 220. First endmost section 320 can fluidly couple to a first-in line regular section 220 (in terms of coolant flow) of the plurality of sections 220 or a second endmost section 420 where only two sections 220 are provided (see FIG. 11). First endmost section 320 may be structured similarly to other regular sections 220. Section 320 may include a wall 322 defining a cooling passage 330 within a third sidewall 334 and a fourth sidewall 336 coupled by a turn portion 338. Turn portion 338 couples to a first end 340 of each of third and fourth sidewalls 334, 336. A second end 344 of third sidewall 334 of wall 322 is coupled to interior surface 216 of body 210 to define another cooling passage 346 between third sidewall 334 and interior surface 216 of body 210. Here, a connector wall 358 couples a second end 364 of fourth sidewall 336 of wall 322 to coolant source(s) 214. Connector wall 358 can include the same flexibility and configurations described herein relative to connector wall 258. In this manner, coolant from coolant source(s) 214 can be directed into sections 220 of cooling circuit 200.

Similarly, cooling circuit 200 can include a second endmost section 420 opposite first endmost section 320 of sections 220. Second endmost section 420 can fluidly couple to a penultimate regular section 220, i.e., last-in line regular section 220 that is not endmost section 420, or first endmost section 320 where only two sections are provided (see FIG. 11). Second endmost section 420 may include a wall 422 defining a cooling passage 430 within a fifth sidewall 434 and a sixth sidewall 436 coupled by a turn portion 438. Turn portion 438 couples to a first end 440 of each of fifth and sixth sidewalls 434, 436. A second end 444 of fifth sidewall 434 of wall 422 couples to interior surface 216 of body 210 to define another cooling passage 446 between fifth sidewall 434 and interior surface 216 of body 210. Wall 422 is spaced from wall 222 of an adjacent section 220, creating a cooling passage 466. Here, a connector wall 450 couples a second end 464 of sixth sidewall 436 of wall 422 to a penultimate section 220 of plurality of sections 220 adjacent second endmost section 420. Second endmost section 420 can include a terminating wall 494 coupling turn portion 438 to interior surface 216 of body 210.

Coolant in cooling circuit 200 can be directed from coolant source(s) 214 through cooling circuit 200 in a closed manner and without allowing any siphoning of coolant for other purposes before reaching a final rearmost section 420 of the circuit. In this case, coolant in cooling passage(s) 430, 446 of second endmost section 420 may be directed from these cooling passages for any use, such as but not limited to: other cooling circuits along interior surface 216 of body 210, trailing edge cooling passages, or film cooling of exterior surface 212 of body 210, e.g., via film cooling hole(s) 298. In other embodiments, coolant can be siphoned at different locations along cooling circuit 200 such as film cooling holes (not shown) in body 210 at any section 220 of the plurality of sections 220. Cooling circuit 200 can also include any variety of other openings and/or passages (not shown) in fluid communication with any cooling passage (e.g., 230, 246, 266, 330, 346, 366, 430, 436, 466) to direct at least a portion of the coolant to another area of HGP component 202 or for film cooling of exterior surface 212 of body 210.

Figure 10:
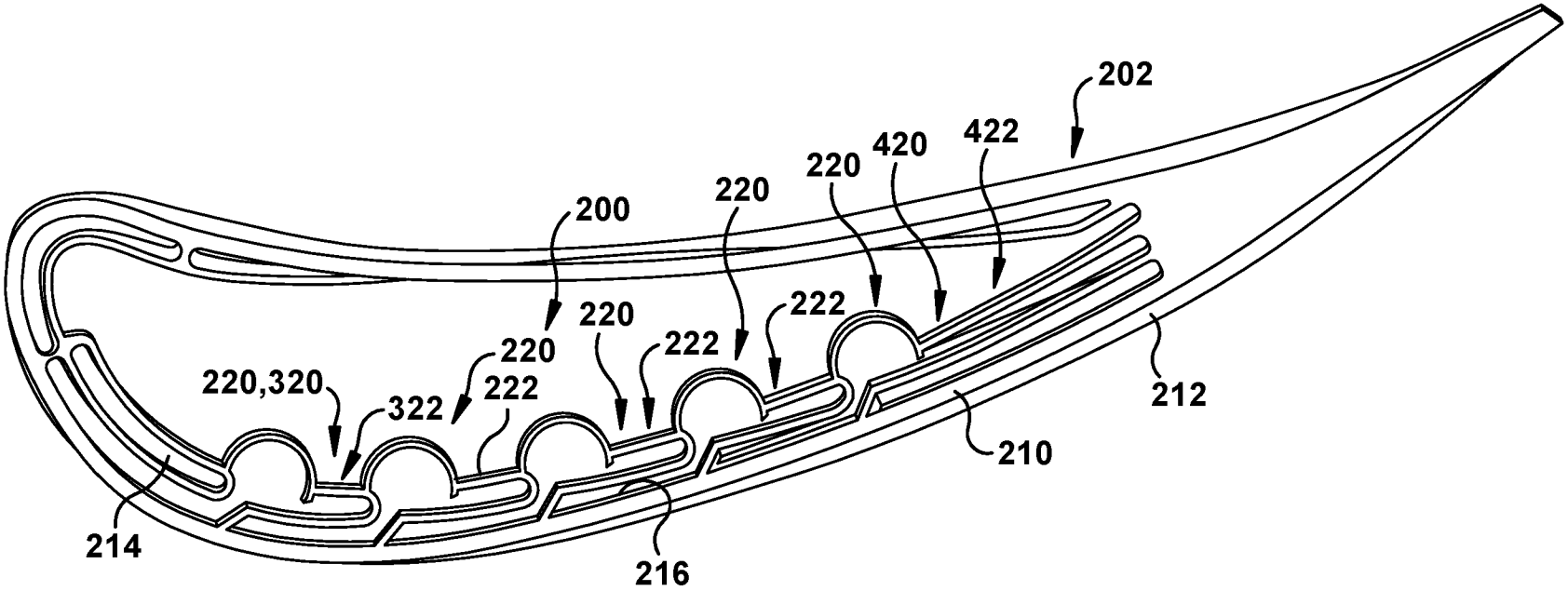
FIG. 10 shows a cross-sectional view of an illustrative HGP component including a cooling circuit, according to other embodiments of the disclosure.
Figure 11:
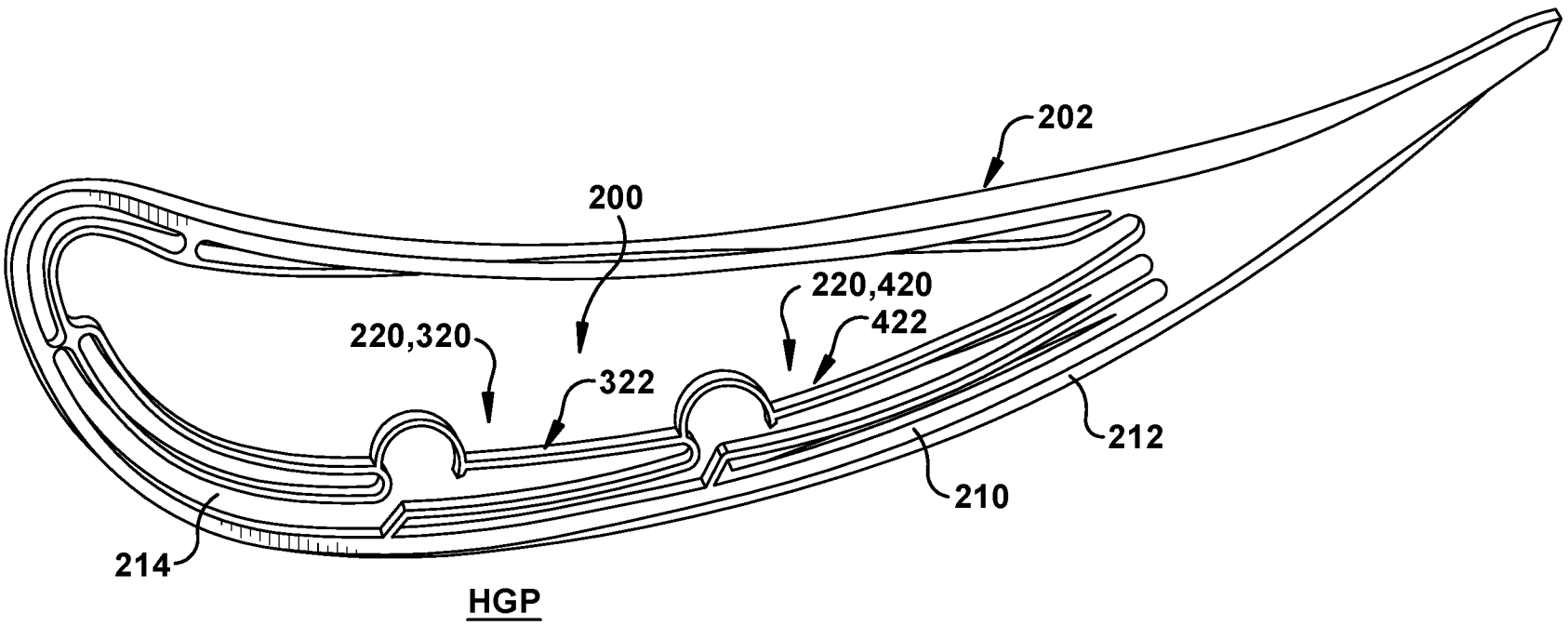
FIG. 11 shows a cross-sectional view of an illustrative HGP component including a cooling circuit, according to additional embodiments of the disclosure.

FIGS. 10 and 11 show cross-sectional views of embodiments of cooling circuit 200 and HGP component 202 having different numbers of sections 220, resulting in slightly different shaped walls than in FIGS. 6-9. FIG. 10 shows an embodiment including five sections 220, i.e., a first endmost section 320, three regular sections 220, and a second endmost section 420. FIG. 11 shows an embodiment including only two sections 220, i.e., a first endmost section 320 and a second endmost section 420. As observed by comparing FIGS. 6, 10 and 11, walls 222, 322, 422 can have any desired length to accommodate as many sections 220 as desired. FIGS. 10 and 11 show sections 220 in a free-standing format. It will be recognized that pillars 270, 272 (FIGS. 6 and 8) and/or tubes 280 (FIG. 9) can be used in the FIGS. 10 and 11 embodiments.

Embodiments of the disclosure decrease stress within HGP component 202 through flexible sections 220 of cooling circuit 200 integrated within the HGP component's other cooling circuits. These flexible sections 220 direct coolant in a reuse scheme and allow for a high performance, multi-wall cooling circuit approach without creating a reduction in life expectancy of the HGP component 202. Cooling circuit 200 thus increases overall turbine performance and durability. While guiding coolant, these sections also allow for more flexibility and stress distribution along an otherwise stiff body 210, providing longer lifecycles and maintenance cycles for the dependent hardware and reducing overall stress concentration in the HGP component 202. The position of cooling circuit 200 can be selected to relieve stress where necessary. In examples shown, stress relief is in a low temperature zone on a suction side of airfoil 152, 176, but it could be located elsewhere.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," is not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A turbine hot gas path (HGP) component, comprising:
a body having an exterior surface for exposing to a hot gas path; and
a cooling circuit defined along an interior surface of the body and fluidly coupled to a coolant source, the cooling circuit including a plurality of sections spaced from one another but fluidly connected, each section including:
a first wall including a first sidewall and a second sidewall coupled by a first turn portion to define a first cooling passage between the first sidewall and the second sidewall, the first turn portion coupling to a first end of each of the first and second sidewalls, a second end of the first sidewall of the first wall coupled to the interior surface of the body to define a second cooling passage between the first sidewall and the interior surface of the body;
a first connector wall coupling a second end of the second sidewall of the first wall of a first section of the plurality of sections to the first wall of an adjacent, second section of the plurality of sections in a spaced manner; and
at least one opening defined in the first sidewall and fluidly coupling the first cooling passage to the second cooling passage.

2. The turbine HGP component of claim 1, wherein the first connector wall is more flexible than the first wall and the body.

3. The turbine HGP component of claim 1, further comprising a plurality of tubes extending through the second sidewall and the first sidewall and terminating at the interior surface of the body.

4. The turbine HGP component of claim 1, further comprising a first plurality of pillars spacing the first sidewall from the second sidewall, and a second plurality of pillars spacing the first sidewall from the interior surface of the body.

5. The turbine HGP component of claim 1, wherein the first connector wall partially defines a third cooling passage fluidly coupling the first cooling passage of the first section of the plurality of sections to the second cooling passage of the adjacent, second section of the plurality of sections.

6. The turbine HGP component of claim 5, wherein the third cooling passage isolates stress between the first section and the adjacent, second section of the plurality of sections.

7. The turbine HGP component of claim 1, wherein the first connector wall is curved away from the interior surface of the body.

8. The turbine HGP component of claim 1, wherein the body is an airfoil of one of a turbine blade and a turbine nozzle.

9. The turbine HGP component of claim 1, wherein the body is a shroud between a turbine blade stage and a turbine nozzle stage.

10. The turbine HGP component of claim 1, further comprising a first endmost section of the plurality of sections, the first endmost section including:

a second wall including a third sidewall and a fourth sidewall coupled by a second turn portion to define a third cooling passage between the third sidewall and the fourth sidewall, the second turn portion coupling to a first end of each of the third and fourth sidewalls, a second end of the third sidewall of the second wall coupled to the interior surface of the body to define a fourth cooling passage between the third sidewall and the interior surface of the body; and a second connector wall coupling a second end of the fourth sidewall of the second wall of the plurality of sections to the coolant source.

11. The turbine HGP component of claim 10, further comprising a second endmost section of the plurality of sections opposite the first endmost section of the plurality of sections, the second endmost section including:

a third wall including a fifth sidewall and a sixth sidewall coupled by a third turn portion to define a fifth cooling passage between the fifth sidewall and the sixth sidewall, the third turn portion coupling to a first end of each of the fifth and sixth sidewalls, a second end of the fifth sidewall of the third wall coupled to the interior surface of the body to define a sixth cooling passage between the fifth sidewall and the interior surface of the body;

a third connector wall coupling a second end of the sixth sidewall of the third wall to a penultimate section of the plurality of sections adjacent the second endmost section of the plurality of sections; and a terminating wall coupling the third turn portion to the interior surface of the body.

12. A turbine hot gas path (HGP) component, comprising:

a body having an exterior surface exposed to a hot gas path;

a cooling circuit defined along an interior surface of the body and fluidly coupled to a coolant source, the cooling circuit including a plurality of sections spaced from one another but fluidly connected, each section including:

a wall defining at least one cooling passage; and a first connector wall coupling between the wall of a first section of the plurality of sections and the wall of an adjacent, second section of the plurality of sections, wherein the wall of the first section and the wall of the adjacent, second section are spaced apart, and wherein the first connector wall is more flexible than: the wall of the first section, the wall of the adjacent, second section, and the body.

13. The turbine HGP component of claim 12, wherein the wall includes a first wall including a first sidewall and a second sidewall coupled by a first turn portion to define a first cooling passage between the first sidewall and the second sidewall, the first turn portion coupling to a first end of each of the first and second sidewalls, a second end of the first sidewall of the first wall coupled to the interior surface of the body to define a second cooling passage between the first sidewall and the interior surface of the body, and wherein the first connector wall couples a second end of the second sidewall of the first wall of a first section of the plurality of sections to the first wall of an adjacent, second section of the plurality of sections.

14. The turbine HGP component of claim 13, further comprising at least one opening defined in the first sidewall and fluidly coupling the first cooling passage to the second cooling passage.

15. The turbine HGP component of claim 13, further comprising a plurality of tubes extending through the second sidewall and the first sidewall and terminating at the interior surface of the body.

16. The turbine HGP component of claim 13, further comprising a first plurality of pillars spacing the first sidewall from the second sidewall, and a second plurality of pillars spacing the first sidewall from the interior surface of the body.

17. The turbine HGP component of claim 13, wherein the first connector wall partially defines a third cooling passage spacing the first section of the plurality of sections from the adjacent, second section of the plurality of sections, and fluidly coupling the first cooling passage of the first section of the plurality of sections to the second cooling passage of the adjacent, second section of the plurality of sections.

18. The turbine HGP component of claim 17, wherein the third cooling passage isolates stress between the first section and the adjacent, second section of the plurality of sections.

19. The turbine HGP component of claim 17, wherein the first connector wall is curved away from the interior surface of the body.

20. The turbine HGP component of claim 13, wherein the body is one of: an airfoil of a turbine blade, an airfoil of a turbine nozzle, and a shroud between a turbine blade stage and a turbine nozzle stage.

* * * * *